US006380839B2

(12) United States Patent
Li et al.

(10) Patent No.: US 6,380,839 B2
(45) Date of Patent: Apr. 30, 2002

(54) SURFACE MOUNT CONDUCTIVE POLYMER DEVICE

(75) Inventors: Lawrence Li, Taipei (TW); Daniel Grindell, Yucaipa, CA (US); Hugo Chang, Taipei Hsien (TW)

(73) Assignee: Bourns, Inc., Riverside, CA (US)

( * ) Notice: Subject to any disclaimer, the term of this patent is extended or adjusted under 35 U.S.C. 154(b) by 0 days.

(21) Appl. No.: 09/776,380

(22) Filed: Feb. 2, 2001

Related U.S. Application Data

(63) Continuation-in-part of application No. 09/215,404, filed on Dec. 18, 1998, now Pat. No. 6,242,997, which is a continuation-in-part of application No. 09/035,196, filed on Mar. 5, 1998, now Pat. No. 6,172,591.

(51) Int. Cl.[7] ..... H01C 7/10; H01C 7/13

(52) U.S. Cl. ..... 338/22 R; 338/313; 338/332; 29/612; 29/610.1

(58) Field of Search ..... 338/22 R, 312, 338/313, 254, 328, 332; 29/612, 610.1, 621

(56) References Cited

U.S. PATENT DOCUMENTS

| | | | | |
|---|---|---|---|---|
| 3,823,217 | A | 7/1974 | Kampe | |
| 4,237,441 | A | 12/1980 | van Konynenburg | 338/22 R |
| 4,238,812 | A | 12/1980 | Middleman et al. | 361/106 |
| 4,317,027 | A | 2/1982 | Middleman et al. | |
| 4,329,726 | A | 5/1982 | Middleman et al. | 361/58 |
| 4,413,301 | A | 11/1983 | Middleman et al. | 361/106 |
| 4,426,633 | A | 1/1984 | Taylor | 338/25 |
| 4,445,026 | A | 4/1984 | Walker | |
| 4,545,926 | A | 10/1985 | Fouts, Jr. et al. | |
| 4,639,818 | A | 1/1987 | Cherian | 361/106 |
| 4,647,894 | A | 3/1987 | Ratell | 338/22 R |
| 4,647,896 | A | 3/1987 | Ratell | 338/22 R |
| 4,685,025 | A | 8/1987 | Carlomagno | 361/106 |
| 4,689,475 | A | 8/1987 | Kleiner et al. | |
| 4,732,701 | A | 3/1988 | Nishii et al. | |
| 4,769,901 | A | 9/1988 | Nagahori | 29/621 |
| 4,774,024 | A | 9/1988 | Deep et al. | |
| 4,787,135 | A | 11/1988 | Nahahori | 29/612 |
| 4,800,253 | A | 1/1989 | Kleiner et al. | |
| 4,849,133 | A | 7/1989 | Yoshida et al. | |
| 4,876,439 | A | 10/1989 | Nagahori | |
| 4,884,163 | A | 11/1989 | Deep et al. | 361/56 |
| 4,907,340 | A | 3/1990 | Fang et al. | 29/610.1 |
| 4,937,551 | A | 6/1990 | Plasko | 338/22 R |
| 4,951,382 | A | 8/1990 | Jacobs et al. | 29/611 |
| 4,951,384 | A | 8/1990 | Jacobs et al. | 29/611 |
| 4,955,267 | A | 9/1990 | Jacobs et al. | 29/611 |
| 4,980,541 | A | 12/1990 | Shafe et al. | |
| 5,049,850 | A | 9/1991 | Evans | 338/0 |
| 5,140,297 | A | 8/1992 | Jacobs et al. | 338/22 R |
| 5,171,774 | A | 12/1992 | Ueno et al. | |
| 5,174,924 | A | 12/1992 | Yamada et al. | |
| 5,178,797 | A | 1/1993 | Evans | |
| 5,181,006 | A | 1/1993 | Safe et al. | 338/22 R |

(List continued on next page.)

FOREIGN PATENT DOCUMENTS

| | | |
|---|---|---|
| WO | 97/06660 | 2/1997 |
| WO | 98/12715 | 3/1998 |

*Primary Examiner*—Lincoln Donovan
*Assistant Examiner*—Kyung S. Lee
(74) *Attorney, Agent, or Firm*—Klein & Szekeres, LLP

(57) ABSTRACT

A surface mount conductive polymer device includes a layer of conductive polymer material laminated between first and second metal foil electrodes. A thermal stress relief area is formed as an etched-out area in each of the electrodes. The etched-out areas are equal in surface area, and they are symmetrically disposed on the two electrodes, so that the two electrodes are themselves symmetrical, and are subject to equal degrees of thermal stress relief. First and second opposed end terminals are formed on the opposed ends of the laminated structure to providing electrical connection to the first and second electrodes, respectively.

35 Claims, 3 Drawing Sheets

U.S. PATENT DOCUMENTS 5,190,697 A 3/1993 Ohkita et al.
5,195,013 A 3/1993 Jacobs et al. ..... 361/106
5,227,946 A 7/1993 Jacobs et al. ..... 361/106
5,241,741 A 9/1993 Sugaya ..... 29/612
5,250,228 A 10/1993 Baigrie et al.
5,280,263 A 1/1994 Sugaya ..... 338/22 R
5,358,793 A 10/1994 Hanada et al.
5,699,607 A * 12/1997 McGuire et al. ..... 29/612
5,802,709 A 9/1998 Hogge et al. ..... 29/827
5,831,510 A * 11/1998 Zhang et al. ..... 338/22 R
5,852,397 A * 12/1998 Chan et al. ..... 338/22 R
5,864,281 A * 1/1999 Zhang et al. ..... 338/22 R
6,172,591 B1 1/2001 Barrett ..... 338/22 R

* cited by examiner

SURFACE MOUNT CONDUCTIVE POLYMER DEVICE

This application is a Continuation-in-part of application Ser. No. 09/215,404; filed Dec. 18, 1998 now U.S. Pat. No. 6,242,997, which is a Continuation-in-part of application Ser. No. 09/035,196; filed Mar. 5, 1998; now U.S. Pat. No. 6,172,591.

FEDERALLY SPONSORED RESEARCH OR DEVELOPMENT

Not Applicable

BACKGROUND OF THE INVENTION

The present invention relates generally to the field of conductive polymer positive temperature coefficient (PTC) devices. More specifically, it relates to conductive polymer PTC devices that are of laminar construction, and that are especially configured for surface-mount installations.

Electronic devices that include an element made from a conductive polymer have become increasingly popular, being used in a variety of applications. They have achieved widespread usage, for example, in overcurrent protection and self-regulating heater applications, in which a polymeric material having a positive temperature coefficient of resistance is employed. Examples of positive temperature coefficient (PTC) polymeric materials, and of devices incorporating such materials, are disclosed in the following U.S. patents:

U.S. Pat. No. 3,823,217—Kampe
U.S. Pat. No. 4,237,441—van Konynenburg
U.S. Pat. No. 4,238,812—Middleman et al.
U.S. Pat. No. 4,317,027—Middleman et al.
U.S. Pat. No. 4,329,726—Middleman et al.
U.S. Pat. No. 4,413,301—Middleman et al.
U.S. Pat. No. 4,426,633—Taylor
U.S. Pat. No. 4,445,026—Walker
U.S. Pat. No. 4,481,498—McTavish et al.
U.S. Pat. No. 4,545,926—Fouts, Jr. et al.
U.S. Pat. No. 4,639,818—Cherian
U.S. Pat. No. 4,647,894—Ratell
U.S. Pat. No. 4,647,896—Ratell
U.S. Pat. No. 4,685,025—Carlomagno
U.S. Pat. No. 4,774,024—Deep et al.
U.S. Pat. No. 4,689,475—Kleiner et al.
U.S. Pat. No. 4,732,701—Nishii et al.
U.S. Pat. No. 4,769,901—Nagahori
U.S. Pat. No. 4,787,135—Nagahori
U.S. Pat. No. 4,800,253—Kleiner et al.
U.S. Pat. No. 4,849,133—Yoshida et al.
U.S. Pat. No. 4,876,439—Nagahori
U.S. Pat. No. 4,884,163—Deep et al.
U.S. Pat. No. 4,907,340—Fang et al.
U.S. Pat. No. 4,951,382—Jacobs et al.
U.S. Pat. No. 4,951,384—Jacobs et al.
U.S. Pat. No. 4,955,267—Jacobs et al.
U.S. Pat. No. 4,980,541—Shafe et al.
U.S. Pat. No. 5,049,850—Evans
U.S. Pat. No. 5,140,297—Jacobs et al.
U.S. Pat. No. 5,171,774—Ueno et al.

U.S. Pat. No. 5,174,924—Yamada et al.
U.S. Pat. No. 5,178,797—Evans
U.S. Pat. No. 5,181,006—Shafe et al.
U.S. Pat. No. 5,190,697—Ohkita et al.
U.S. Pat. No. 5,195,013—Jacobs et al.
U.S. Pat. No. 5,227,946—Jacobs et al.
U.S. Pat. No. 5,241,741—Sugaya
U.S. Pat. No. 5,250,228—Baigrie et al.
U.S. Pat. No. 5,280,263—Sugaya
U.S. Pat. No. 5,358,793—Hanada et al.

One common type of construction for conductive polymer PTC devices is that which may be described as a laminated structure. Laminated conductive polymer PTC devices typically comprise a single layer of conductive polymer material sandwiched between a pair of metallic electrodes, the latter preferably being a highly-conductive, thin metal foil. See, for example, U.S. Pat. Nos. 4,426,633—Taylor; 5,089,801—Chan et al.; 4,937,551—Plasko; 4,787,135—Nagahori; 5,669,607—McGuire et al.; and 5,802,709—Hogge et al.; and International Publication Nos. WO97/06660 and WO98/12715.

In meeting a demand for higher component density on circuit boards, the trend in the industry has been toward increasing use of surface mount components as a space-saving measure. In accordance with this trend, laminated conductive polymer PTC devices have increasingly been designed and constructed as surface-mount devices (SMD's). Typically, an SMD is manufactured with a pair of opposed terminals that include a solder overcoat layer. See, e.g., U.S. Pat. No. 6,172,591, the disclosure of which is incorporated herein by reference. The device is attached to a printed circuit (PC) board by reflow soldering, whereby the solder layer on the terminals is melted when the device is brought into contact with solder-coated contact pads on the PC board. One problem with the reflow soldering process is that of so-called "tombstoning." This effect occurs when thermal stresses experienced by the device during the reflow soldering process (due to different coefficients of thermal expansion between the foil electrodes and the layer of polymer PTC material laminated between them) cause the device to tip out of the horizontal plane. The tombstoning effect may be exacerbated when the solder melting on the terminals does not occur simultaneously, with the result that the terminal at which the solder melts more slowly is elevated with respect to the other terminal. The ultimate result of the tombstoning effect may be a solder joint that is physically and/or electrically degraded.

At present, the only practical way to address the above-described problem is by post-manufacture inspection and testing, which results in reduced yields due to rejection of PC boards with "tombstoned" devices. Furthermore, there is the possibility that some defective PC boards will escape detection, with the attendant risk that a defective board will fail after installation in a piece of electronic equipment. Accordingly, there has been a long-felt, but as yet unsatisfied need to reduce the incidence of tombstoning during the reflow soldering process.

SUMMARY OF THE INVENTION

Broadly, the present invention is a surface mount conductive polymer PTC device, comprising a layer of conductive polymer PTC material laminated between first and second metal foil electrodes to form a laminated structure, wherein a thermal stress relief area is formed in each of the electrodes. In a specific preferred embodiment, each of the thermal stress relief areas is formed as an etched-out area in one of the electrodes. The etched-out areas are equal in surface area, and they are symmetrically disposed on the two electrodes, so that the two electrodes are themselves symmetrical, and are subject to equal degrees of thermal stress relief. First and second opposed end terminals are formed on the opposed ends of the laminated structure to providing electrical connection to the first and second electrodes, respectively.

The external surfaces of the first and second electrodes are fully-metallized, except for the stress relief areas, so as to provide a large surface area for the adhesion of the upper and lower ends of the first and second terminals to the first and second electrodes, respectively. An external insulation layer applied over the metallized external electrode surfaces between the ends of the first and second terminals to provide electrical isolation between the first and second terminals, wherein the external insulation layer is flush with the upper and lower ends of the terminals. The external insulation layer also fills in the etched-out stress relief areas.

The etched-out stress relief areas in both of the electrodes provide balanced compensation for the thermal stresses induced by the unequal expansion of the polymer layer and the foil electrode layers during the reflow soldering process. Thus, the probability and the degree of thermal stress-induced tipping of the device will be reduced. Furthermore, because the tipping of the device due to thermal stresses may, in fact, contribute to the unequal melting of the solder at the terminals, the thermal stress relief provided by the etched out areas will substantially reduce, if not eliminate, the problem of tombstoning.

In another aspect, the present invention is a method of fabricating the above-described device. Broadly, such a method would comprise the steps of: (1) providing a laminated structure comprising a conductive polymer PTC layer sandwiched between first and second metal layers; (2) isolating selected areas of the first and second metal layers to form, respectively, first and second arrays of metal strips; (3) forming a plurality of thermal stress relief areas in each of the metal strips in the first and second arrays; (4) forming a first plurality of insulation areas on the exterior surface of each of the first array of metal strips and a second plurality of insulation areas on the exterior surface of each of the second array of metal strips; (5) forming a plurality of first terminals, each electrically connected to one of the metal strips in the first array, and a plurality of corresponding second terminals, each electrically connected to one of the metal strips in the second array, each of the first terminals being isolated from a corresponding second terminal by one of the first plurality of insulation areas and one of the second plurality of insulation areas; and (6) separating the laminated structure into a plurality of devices, each comprising a conductive polymer layer sandwiched between a first electrode formed from one of the metal strips in the first array and a second electrode formed from one of the metal strips in the second array; a first terminal in electrical contact only with the first electrode; and a second terminal in electrical contact only with the second electrode.

More specifically, the step of isolating selected areas of the first and second metal layers comprises the steps of: (2)(a) forming a series of substantially parallel linear slots through the laminated structure; (2)(b) plating the internal side walls of the slots and the exterior surfaces of the first and second metal layers with a conductive metal plating layer; and (2)(c) etching a series of substantially linear isolation gaps in each of the first and second metal layers, including the metal plating layer applied thereto.

Thus, in a specific preferred embodiment, the method comprises the steps of: (1) providing a laminated structure comprising a conductive polymer PTC layer sandwiched between first and second metal foil layers; (2) forming a series of parallel linear slots through the laminated structure; (3) plating the side walls of the slots and the exterior surfaces of the first and second metal layers with a conductive metal plating; (4) isolating selected areas of the plated first and second metal foil layers to form, respectively, first and second arrays of electrode strips; (5) forming a pattern of thermal stress relief areas in each of the electrode strips in the first and second electrode strip arrays; (6) forming a plurality of insulation areas on the exterior surface of each of the electrode strips in the first and second electrode strip arrays; (7) forming a plurality of first terminals, each in contact with one of the electrode strips in the first electrode strip array, and a plurality of second terminals, each in contact with one of the electrode strips in the second electrode strip array, wherein each of the first terminals is separated from a second terminal by one of the insulation areas on each of the first and second electrode strip arrays; and (8) separating or singulating the laminated structure into a plurality of devices, each comprising a conductive polymer PTC layer sandwiched between a first electrode formed from one of the first array of electrode strips and a second electrode formed from one of the second array of electrode strips, a thermal stress relief area in each of the first and second electrodes, and first and second terminals respectively contacting the first and second electrodes.

In accordance with this specific preferred embodiment, the step of isolating selected areas of the plated first and second metal layers includes the step of etching a first series of parallel, linear isolation gaps in the plated first metal layer, and a second series of parallel, linear isolation gaps in the second plated metal layer, to form first and second arrays, respectively, of parallel electrode strips. The isolation gaps in the first and second metal layers are staggered so that the electrode strips in the first array are staggered with respect to those in the second array, wherein the each of the isolation gaps in the first metal layer is adjacent one of a first set of slots, and the each of the isolation gaps in the second metal layer is adjacent one of a second set of slots that alternate with the first set. Thus, each electrode strip in the first electrode strip array comprises a first linear array of electrodes formed in the first metal layer, each defined between one of the slots in the first set of slots and one of the isolation gaps in the first series of isolation gaps, while each electrode strip in the second electrode strip array comprises a second linear array of electrodes in the second metal layer, each defined between one of the slots in the second set of slots and one of the isolation gaps in the second series of isolation gaps, wherein the electrodes in the first linear electrode array are on the opposite sides of the slots from the electrodes in the second linear electrode array. Furthermore, because of the asymmetric spacing of the isolation gaps between successive slots, each isolation gap separates one of the linear electrode arrays from a narrow metal band, and each slot has a narrow metal band on one side and a linear electrode array on the other side.

The step of forming a pattern of thermal stress relief areas is performed by etching a linear pattern of defined etched-out areas in each of the electrode strips in the first and second arrays of electrode strips. The etching is done through the plating and the metal foil, down to the polymer layer. Each of the etched-out areas in the electrode strips of the first electrode strip array is aligned with an isolation gap in the in the second plated metal layer, and each of the etched-out areas in the electrode strips in the second electrode strip array is aligned with an isolation gap in the first plated metal layer.

The step of forming a plurality of insulation areas comprises the step of screen printing a layer of insulation material on both of the external surfaces of the laminated structure, along each of the electrode strips. The insulation layers are applied so that the isolation gaps and the thermal stress relief areas are filled with insulation material, but a substantial portion of each of the electrode strips along each of the slots is left uncovered or exposed. The narrow metal bands are also left uncovered.

The step of forming the first and second terminals comprises the step of overlaying a solder plating over the metal-plated surfaces that are not covered by the insulation layer. The solder plating is thus applied to the interior wall surfaces of the slots, the narrow external metal bands, and the exposed portions of the electrode strips.

The final step of the fabrication process comprises the step of singulating the laminated structure into a plurality of individual conductive polymer PTC devices, each of which has the structure described above. Specifically, the electrode strips in the first and second plated metal layers are formed, by the singulation step, respectively into first and second pluralities of external electrodes.

While a device having a single conductive polymer PTC layer is described herein, it will be appreciated that a device having two or more such layers can be constructed in accordance with the present invention.

The above-mentioned advantages of the present invention, as well as others, will be more readily appreciated from the detailed description that follows.

DETAILED DESCRIPTION OF THE INVENTION

Figure 1:
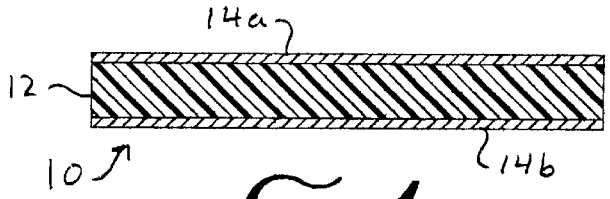
FIG. 1 is a cross-sectional view of a laminated structure comprising a conductive polymer PTC layer laminated between two metal foil layers, illustrating the first step of a conductive polymer PTC device fabrication method in accordance with a preferred embodiment of the present invention.
Figure 2:
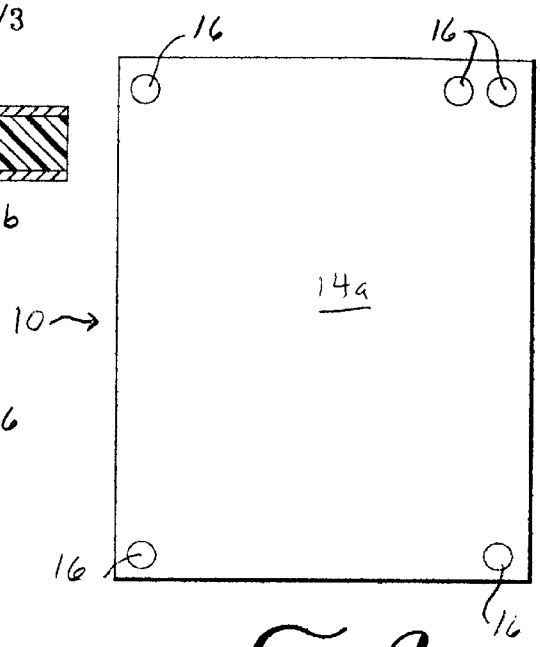
FIG. 2 is a top plan view of the laminated structure of FIG. 1.

Referring now to the drawings, FIGS. 1 and 2 illustrate a laminated structure or web 10, which is provided as the initial step in the process of fabricating a conductive polymer PTC device in accordance with the present invention. The laminated web 10 comprises a layer 12 of conductive polymer PTC material sandwiched between first and second metal layers 14*a*, 14*b*. The conductive polymer PTC layer 12 may be made of any suitable conductive polymer PTC composition, such as, for example, high density polyethylene (HDPE) into which is mixed an amount of carbon black that results in the desired electrical operating characteristics. See, for example, U.S. Pat. No. 5,802,709—Hogge et al., , assigned to the assignee of the present invention, the disclosure of which is incorporated herein by reference.

The metal layers 14*a*, 14*b* may be made of copper or nickel foil. If the metal layers 14*a*, 14*b* are made of copper foil, those foil surfaces that contact the conductive polymer layer 12 are coated with a nickel flash coating (not shown) to prevent unwanted chemical reactions between the polymer and the copper. These polymer contacting surfaces are also preferably "nodularized", by well-known techniques, to provide a roughened surface that provides good adhesion between the metal and the polymer.

The laminated web 10 may be formed by any of several suitable processes that are known in the art, as exemplified by U.S. Pat. Nos. 4,426,633—Taylor; 5,089,801—Chan et al.; 4,937,551—Plasko; and 4,787,135—Nagahori, with the process disclosed in U.S. Pat. No. 5,802,709—Hogge et al. and International Publication No. WO97/06660 being preferred.

It is advantageous at this point to provide some means for maintaining the web 10 in the proper relative orientation or registration for carrying out the subsequent steps in the fabrication process. Preferably, this is done by forming (e.g., by punching or drilling) a plurality of registration holes 16 in the comers of the web 10, as shown in FIG. 2. Other registration techniques, well known in the art, may also be used.

At this point, the polymeric material in the laminated structure 10 may be cross-linked, by well-known methods, if desired for the particular application in which the device will be employed.

Figure 3:
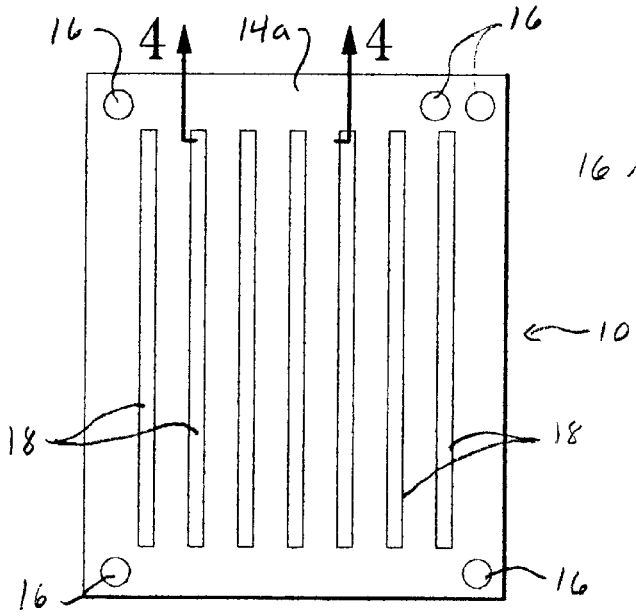
FIG. 3 is a top plan view, similar to that of FIG. 2, after the step of forming slots through the laminated structure of FIG. 1 has been performed.
Figure 4:
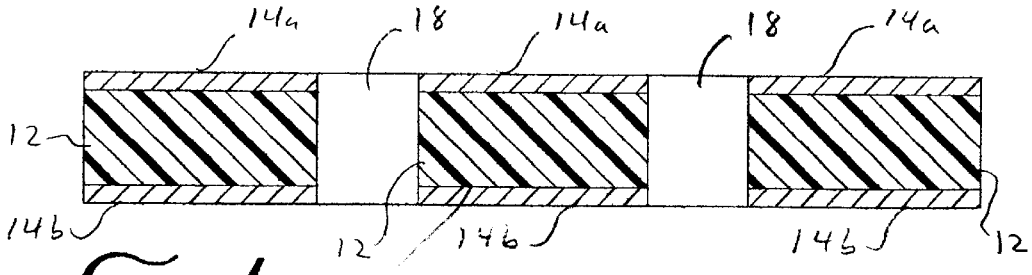
FIG. 4 is a cross-sectional view, taken along line 4—4 of FIG. 3.

After the laminated structure 10 has been formed, a series of parallel, linear slots 18 is formed through the laminated structure 10, as shown in FIGS. 3 and 4. The slots 18 may be formed by drilling, routing, or punching the laminated structure 10 completely through the metal layers 14*a*, 14*b* and the polymer layer 12.

Figure 5:
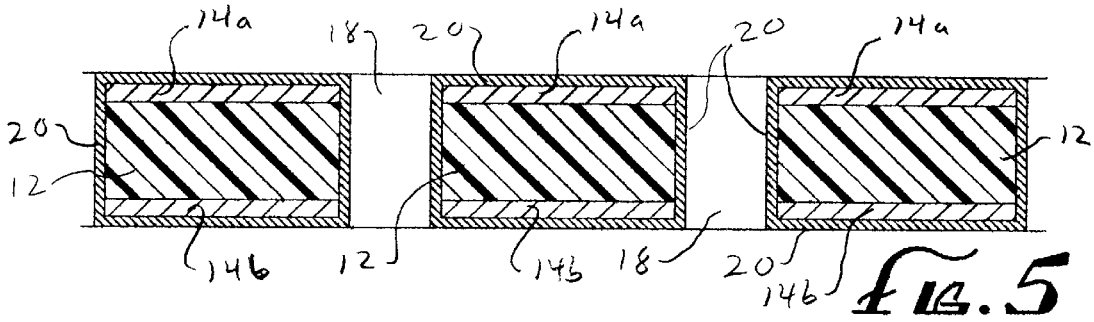
FIG. 5 is a cross-sectional view, similar to that of FIG. 4, after the step of metal plating has been performed.

Next, as shown in FIG. 5, the exposed exterior surfaces of the first and second metal layers 14*a*, 14*b*, and the interior wall surfaces of the slots 18 are coated with a plating layer 20 of conductive metal, such as tin, nickel, or copper, with copper being preferred. Alternatively, the plating layer 20 may comprise a layer of copper over a very thin base layer (not shown) of nickel, for improved adhesion. This metal plating step can be performed by any suitable process, such as electrodeposition, for example. The metal plating layer 20 may be defined as having a first portion that is applied to the interior wall surfaces of the slots 18, and second and third portions that are applied to the external surfaces of the first and second metal layers 14*a*, 14*d*, respectively.

Figure 6A:
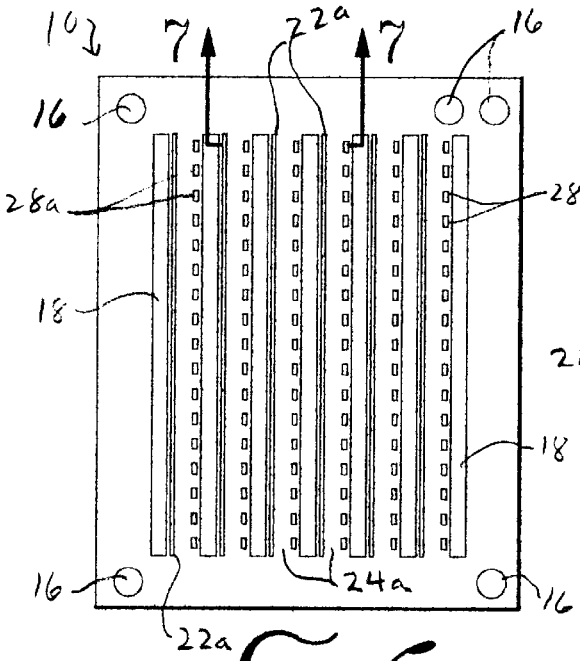
FIGS. 6A and 6B are top and bottom plan views, respectively, of the laminated structure after the step of forming isolation gaps in the first and second plated metal layers is performed.
Figure 6B:
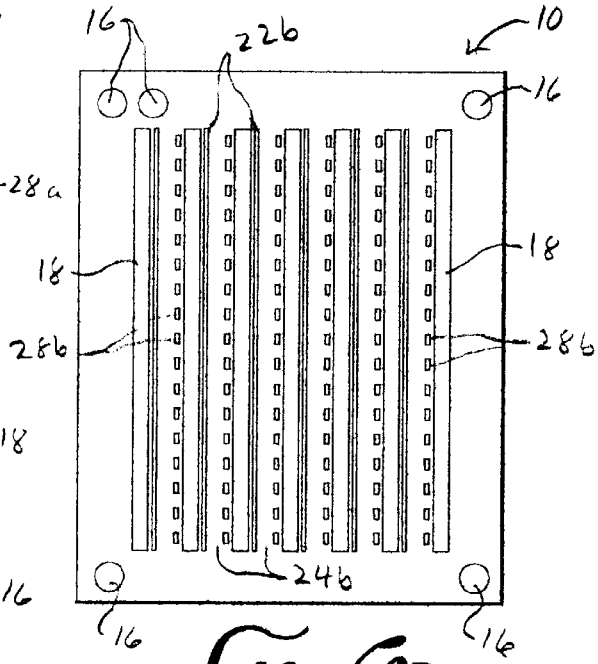
Figure 7:
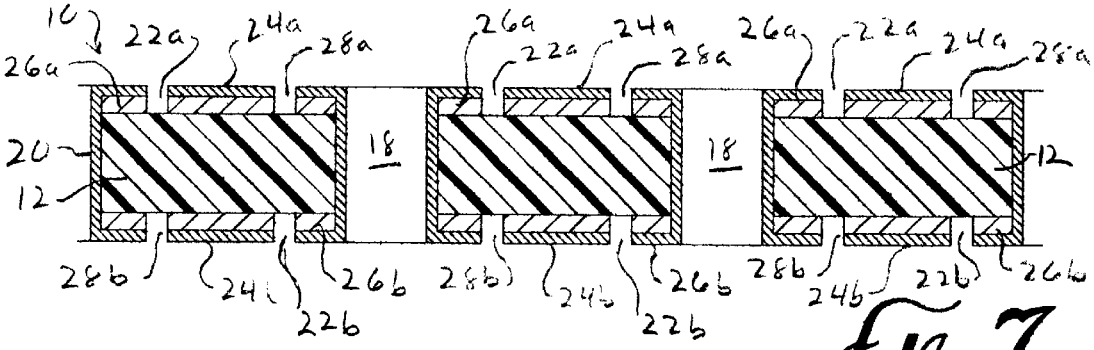
FIG. 7 is a cross-sectional view, taken along line 7—7 of FIG. 6A.

FIGS. 6A, 6B, and 7 illustrate the step of forming a first series of parallel, linear isolation gaps 22*a* in the first metal layer 14*a*, including the metal plating layer 20 applied thereto. A second series of parallel, linear isolation gaps 22*b* is formed in the second metal layer 14*b*, likewise through the plating layer 20. The isolation gaps 22*a* in the first series are staggered with respect to the isolation gaps 22*b* in the second series. Specifically, the isolation gaps 22*a* in the first metal layer 14*a* are adjacent a first set of the slots 18, and the isolation gaps 22*b* in the second metal layer 14*b* are adjacent a second set of the slots 18 that alternate with the first set. The isolation gaps 22*a*, 22*b* may be formed by any suitable process, such as those methods employing photo-resist and etching techniques.

The isolation gaps 22*a* in the first metal layer 14*a* divide the first metal layer 14*a* into a first array of electrode strips 24*a*, each defined between a slot 18 and one of the first series of isolation gaps 22*a*. Likewise, the isolation gaps 22*b* in the second metal layer 14*b* divide the second metal layer 14*b* into a second array of electrode strips 24*b*, each defined between a slot 18 and one of the second series of isolation gaps 22*b*, wherein the electrode strips 24*a* in the first array are on the opposite sides of the slots 18 from the electrode strips 24*b* in the second array. Furthermore, because of the asymmetric spacing of the isolation gaps 22*a*, 22*b* between successive slots 18, each isolation gap 22*a*, 22*b* separates one of the electrode strips 24*a*, 24*b* from a narrow metal band 26*a*, 26*b*, respectively, and each slot 18 has a narrow metal band 26*a* or 26*b* on one side, and an electrode strip 24*a* or 24*b* on the other side. Each of the electrode strips 24*a*, 24*b* and the narrow metal bands 26*a*, 26*b* comprises an inner foil layer and an outer metal-plated layer.

FIGS. 6A, 6B, and 7 also illustrate the step of forming first and second arrays of thermal stress relief areas 28*a*, 28*b* in the first and second electrode strip arrays 24*a*, 24*b*, respectively. These areas are advantageously formed by etching at the same time that the isolation gaps 22*a*, 22*b* are formed. Each of the arrays of stress relief areas 28*a*, 28*b* comprises a plurality of parallel linear patterns of defined etched-out areas, each linear pattern being parallel and adjacent to one of the slots 18. From FIG. 7, it can be seen that each of the thermal stress relief areas 28*a* in the electrode strips 24*a* in the first electrode strip array is in alignment (vertical alignment, as shown in FIG. 7) with one of the isolation gaps 22*b* in the second metal layer 14*b*. Similarly, each of the stress relief areas 28*b* in the electrode strips 24*b* in the second electrode strip array is aligned with one of the isolation gaps 22*a* in the first metal layer 22*a*. In other words, each of the thermal stress relief areas 28*a*, 28*b* is in vertical (as seen in the drawings) opposition to one of the isolation gaps 22*b*, 22*a*, respectively, in the opposite metal layer. The stress relief areas 28*a*, 28*b* are of equal surface area.

Figure 8:
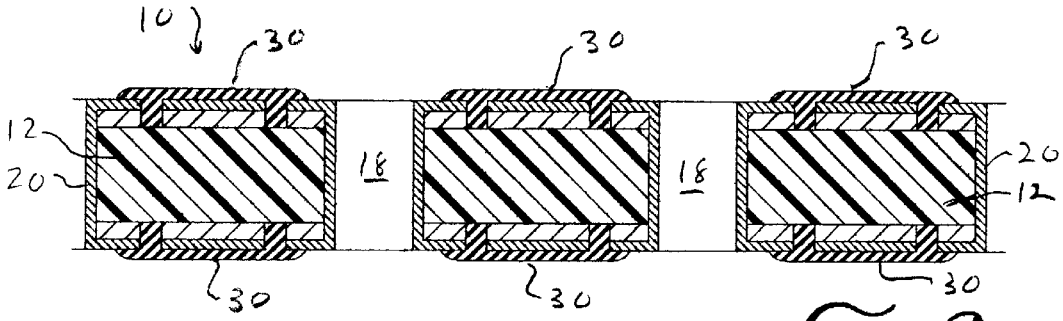
FIG. 8 is a cross-sectional view, similar to that of FIG. 7, after the step of forming insulation areas on the external surfaces of the plated metal layers has been performed.

FIG. 8 illustrates the step of forming a plurality of insulation areas 30 on both of the major external surfaces (i.e., the top and bottom surfaces) of the laminated structure 10. This step is advantageously performed by screen printing a layer of insulation material on both of the appropriate surfaces of the laminated structure 10, along each of the electrode strips 24*a*, 24*b*. The insulation areas 30 are configured so that the isolation gaps 22*a*, 22*b* and the thermal stress relief areas 28*a*, 28*b* are filled with insulation material, but a substantial portion of each of the electrode strips 24*a*, 24*b* along each of the slots 18 is left uncovered or exposed. Although the insulation areas 30 may cover a small adjacent portion of the narrow bands 26*a*, 26*b*, most, if not all, of the surface area of each of the narrow bands 26*a*, 26*b* is left uncovered by the insulation layers 30.

Figure 9:
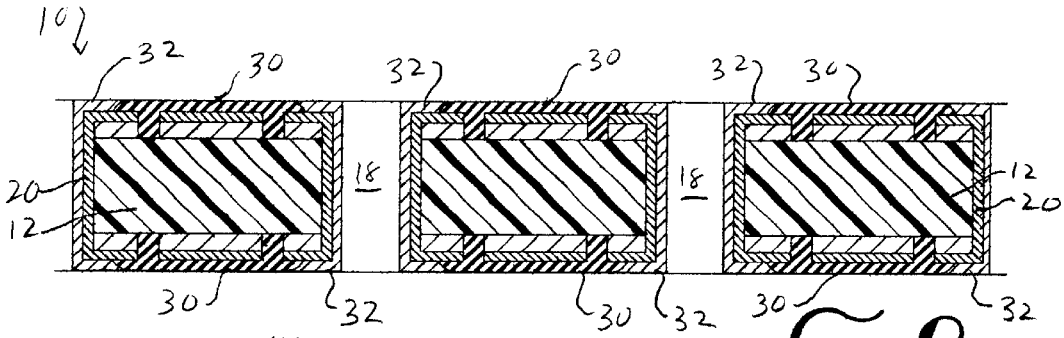
FIG. 9 is a cross-sectional view, similar to that of FIG. 8, after the step of forming the terminals has been performed.

Then, as shown in FIG. 9, the areas that were metal-plated with the plating layer 20 in the step discussed above in connection with FIG. 5 are again plated with a thin solder coating 32. The solder coating 32, which is preferably applied by electroplating, but which can be applied by any other suitable process that is well-known in the art (e.g., reflow soldering or vacuum deposition), covers the portion of the metal plating layer 20 that was applied to the interior wall surfaces of the slots 18, and those portions of the electrode strips 24*a*, 24*b* and the narrow metal bands 26*a*, 26*b* that are left uncovered by the insulation layers 30. It is important that the solder coating 32 is flush with the insulation layer 30. Therefore, the thicknesses of both the insulation layer 30 and the solder coating 32 must be controlled to assure that a substantially flush surface is provided on both the top and bottom surfaces of the laminated structure 10, as shown in FIG. 9.

Figure 11:
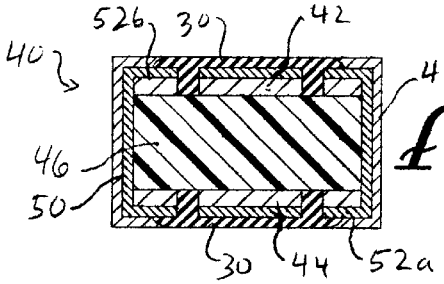
FIG. 11 is a cross-sectional view taken along line 11—11 of FIG. 11.
Figure 12:
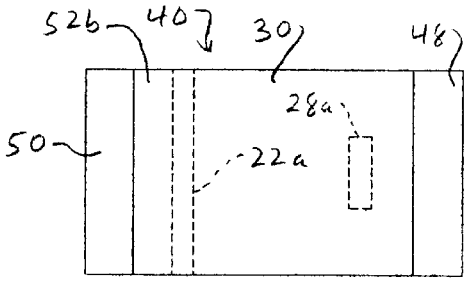
FIG. 12 is a top plane view of the device of FIG. 10, showing the isolation gap and the thermal stress relief area in phantom.
Figure 10:
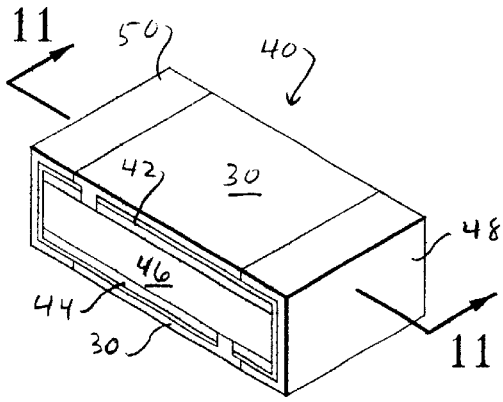
FIG. 10 is a perspective view of a surface mount conductive polymer PTC device after singulation from the laminated structure.

Finally, the laminated structure 10 is singulated (by well-known techniques) preferably along a grid of score lines (not shown) to form a plurality of individual conductive polymer PTC devices, one of which is shown in FIGS. 10, 11, and 12, designated by the numeral 40. After singulation, the device 40 includes a first electrode 42, formed from one of the first array of electrode strips 24*a*, and a second electrode 44, formed from one of the second array of external metal strips 24*b*. A conductive polymer PTC element 46, formed from the polymer layer 12, is located between the first electrode 42 and the second electrode 44. That is, the polymer layer 12 has a first planar surface contacted by an internal surface of the first electrode 42, and a second opposed planar surface contacted by an internal surface of the second electrode 44.

The device 40 has first and opposed end surfaces that are covered by a first terminal 48 and a second terminal 50, respectively. Each of the terminals 48, 50 is formed from the solder plating layer 32 and the underlying portion of the metal plating layer 20, described above. The first and second terminals 48, 50 form the entire end surfaces and parts of the top and bottom surfaces of the device 40. The remaining portions of the top and bottom surfaces of the device 40 are formed by the insulation layers 30, which electrically isolate the first and second terminals 48, 50 from each other.

As best seen in FIGS. 10 and 11, the first terminal 48 is in intimate physical contact with the first electrode 42, and the second terminal 50 is in intimate physical contact with the second electrode 44. The first terminal 48 is also in contact with a bottom metal segment 52*a*, which is formed from one of the above-described narrow metal bands 26*a*, while the second terminal 50 is in contact with a second metal segment 52*b*, which is formed from the other of the narrow metal bands 26*b*. The metal segments 52*a*, 52*b* are of such small area as to have a negligible current-carrying capacity, and thus do not function as electrodes, as will be seen below.

For the purposes of this description, the first terminal 48 may be considered an input terminal, and the second terminal 50 may be considered an output terminal, but these assigned roles are arbitrary, and the opposite arrangement may be employed. With the terminals 48, 50 so defined, the current path through the device 40 is as follows: From the input terminal 48 current flows through the first electrode 42, the conductive polymer PTC layer 46, and the second electrode 44 to the output terminal 50.

The device 40 in accordance with the present invention is characterized by the metallized surface on each of the first and second electrodes 42, 44 being sized to provide a large surface area for the adhesion of the upper and lower ends of the first and second terminals 48, 50 on the upper and lower surfaces, respectively, of the device 40. The improvement is further characterized by the external insulation layer 30 applied over the metallized external surfaces of the electrodes 42, 44, between the ends of the first and second terminals 48, 50, wherein the external insulation layer 30 is flush with the solder planting 32 of the terminals 48, 50 on the upper and lower surfaces of the device 40.

The device 40 is further characterized by a first isolation gap 22*a* and a first thermal stress relief area 28*a* in the first electrode 42, and a second isolation gap 22*b* and a second thermal stress relief area 28*b* in the second electrode 44. The first thermal stress relief area 28*a* is vertically aligned with (directly overlies) the second isolation gap 22*b*, and the first isolation gap 22*a* is vertically aligned with (directly overlies) the second thermal stress relief area 28*b*.

The surface area of each of the thermal stress relief areas 28*a*, 28*b* will be a function largely of the expected electrical characteristics of the device 40, especially the expected power density. In other words, there must be sufficient surface area for the electrodes 42, 44 (minus the surface area of the thermal stress relief areas 28*a*, 28*b*) to handle the expected power densities. Typically, each of the thermal stress relief areas 28*a*, 28*b* will have a width that is about 25% to about 33% of the total width of the device. In any event, the surface area of the first thermal stress relief area 28*a* and the second thermal stress relief area are equal, so that the total surface areas of the first and second electrodes 42, 44 are equal. Moreover, the thermal stress relief areas 28*a*, 28*b* are symmetrically disposed on the two electrodes 42, 44, so that the two electrodes 42, 44 are themselves symmetrical, and are subject to equal degrees of thermal stress relief.

While exemplary embodiments have been described in detail in this specification and in the drawings, it will be appreciated that a number of modifications and variations may suggest themselves to those skilled in the pertinent arts. For example, the fabrication process described herein may be employed with conductive polymer compositions of a wide variety of electrical characteristics, and is thus not limited to those exhibiting PTC behavior. It will also be readily apparent that the fabrication method described above may be easily adapted to the manufacture of a device having fewer than three or more than three conductive polymer layers. Furthermore, while the present invention is most advantageous in the fabrication of surface mount devices, it may be readily adapted to the fabrication of conductive polymer devices having a wide variety of physical configurations and board mounting arrangements. These and other variations and modifications are considered the equivalents of the corresponding structures or process steps explicitly described herein, and thus are within the scope of the invention as defined in the claims that follow.

What is claimed is:

1. A method of fabricating an electronic device, comprising the steps of:

(1) providing a laminated structure comprising a conductive polymer PTC layer sandwiched between first and second metal layers;

(2) isolating selected areas of the first and second metal layers to form, respectively, first and second arrays of electrode strips;

(3) forming a pattern of thermal stress relief areas in each of the electrode strips in the first and second arrays;

(4) forming a first plurality of insulation areas on the exterior surface of each of the first array of electrode strips and a second plurality of insulation areas on the exterior surface of each of the second array of electrode strips;

(5) forming a plurality of first terminals, each electrically connected to one of the electrode strips in the first array, and a plurality of corresponding second terminals, each electrically connected to one of the electrode strips in the second array, each of the first terminals being isolated from a corresponding second terminal by one of the first plurality of insulation areas and one of the second plurality of insulation areas; and (6) separating the laminated structure into a plurality of devices, each comprising a conductive polymer layer sandwiched between a first electrode formed from one of the electrode strips in the first array and a second electrode formed from one of the electrode strips in the second array; a first terminal in electrical contact with the first electrode; and a second terminal in electrical contact with the second electrode.

2. The method of claim 1, wherein the conductive polymer exhibits PTC behavior.

3. The method of claim 1, wherein the metal layers are made of a material selected from the group consisting of nickel foil and nickel-coated copper foil.

4. The method of claim 1 wherein the step of isolating selected areas of the first and second metal layers comprises the step of etching a series of substantially parallel linear isolation gaps in each of the first and second metal layers to form the first and second arrays of electrode strips.

5. The method of claim 1 wherein the step of isolating selected areas of the first and second metal layers comprises the steps of:

(2)(a) forming a series of substantially parallel linear slots through the laminated structure;

(2)(b) plating the internal side walls of the slots and the exterior surfaces of the first and second metal layers with a conductive metal plating layer; and (2)(c) etching a series of substantially linear isolation gaps in each of the first and second metal layers, including the metal plating layer applied thereto.

6. The method of claim 5, wherein the step of etching a series of isolation gaps is performed so that the isolation gaps that are formed in the first metal layer are adjacent a first set of the slots, and the isolation gaps that are formed in the second metal layer are adjacent a second set of the slots that alternate with the first set.

7. The method of claim 5, wherein the step of forming the plurality of insulation areas comprises the step of depositing a layer of insulation material over the conductive metal plating layer on the exterior surfaces of the first and second arrays of electrode strips so as to fill in the isolation gaps and the thermal stress relief areas with the insulation material, and so as to leave portions of the first and second metal layers adjacent each of the slots with exposed metal plating from the plating step.

8. The method of claim 7, wherein the step of forming the pluralities of first and second terminals comprises the step of depositing a solder layer on the plated internal walls of the slots and on the portions of the first and second metal layers with exposed metal plating.

9. The method of claim 8, wherein the step of depositing the solder layer is performed so that the portion of the solder layer that is deposited on the first and second metal layers is substantially flush with the layer of insulation material.

10. The method of claim 5, wherein the step of forming a pattern of thermal stress relief areas is performed by etching a linear pattern of defined etched-out areas in each of the electrode strips in the first and second arrays of electrode strips.

11. The method of claim 10, wherein each of the etched-out areas in the electrode strips of the first electrode strip array is aligned with an isolation gap in the in the second plated metal layer, and each of the etched-out areas in the electrode strips in the second electrode strip array is aligned with an isolation gap in the first plated metal layer.

12. The method of claim 1 wherein the step of forming a pattern of thermal stress relief areas is performed by etching a linear pattern of defined etched-out areas in each of the electrode strips in the first and second arrays of electrode strips.

13. A method of fabricating an electronic device, comprising the steps of:

(1) providing a laminated structure comprising a first conductive polymer layer sandwiched between first and second metal layers;

(2) isolating selected areas of the first and second metal layers to form, respectively, first and second arrays of electrode strips;

(3) forming a linear pattern of thermal stress relief areas in each of the electrode strips in the first and second arrays;

(4) forming a first plurality of insulation areas on the exterior surface of each of the first array of electrode strips and a second plurality of insulation areas on the exterior surface of each of the second array of electrode strips, each of the insulation areas covering a linear pattern of thermal stress relief areas in one of the electrode strips; and (5) forming a plurality of first terminals, each electrically connected to one of the electrode strips in the first array, and a plurality of corresponding second terminals, each electrically connected to one of the electrode strips in the second array, each of the first terminals being isolated from a corresponding second terminal by one of the first plurality of insulation areas and one of the second plurality of insulation areas.

14. The method of claim 13, wherein the conductive polymer exhibits PTC behavior.

15. The method of claim 13, wherein the metal layers are made of a material selected from the group consisting of nickel foil and nickel-coated copper foil.

16. The method of claim 13 further comprising the step of:

(6) separating the laminated structure into a plurality of devices, each comprising:

a conductive polymer layer sandwiched between a first electrode formed from one of the electrode strips in the first array and a second electrode formed from one of the electrode strips in the second array;

a first terminal in electrical contact with the first electrode; and a second terminal in electrical contact with the second electrode.

17. The method of claim 13 wherein the step of isolating selected areas of the first and second metal layers comprises the steps of:

(2)(a) forming a series of substantially parallel linear slots through the laminated structure;

(2)(b) plating the internal side walls of the slots and the exterior surfaces of the first and second metal layers with a conductive metal plating layer; and (2)(c) etching a series of substantially linear isolation gaps in each of the first and second metal layers, including the metal plating layer applied thereto.

18. The method of claim 17, wherein the step of etching a series of isolation gaps is performed so that the isolation gaps that are formed in the first metal layer are adjacent a first set of the slots, and the isolation gaps that are formed in the second metal layer are adjacent a second set of the slots that alternate with the first set.

19. The method of claim 17, wherein the step of forming the first and second pluralities of insulation areas comprises the step of depositing first and second layers of insulation material over the conductive metal plating layer on the exterior surface of the first and second metal layers, respectively, so as to fill in the isolation gaps and the thermal stress relief areas with the insulation material, and so as to leave portions of the first and second metal layers adjacent each of the slots with exposed metal plating from the plating step.

20. The method of claim 19, wherein the step of forming the pluralities of first and second terminals comprises the step of depositing a solder layer on the plated internal walls of the slots and on the portions of the first and second metal layers with exposed metal plating.

21. The method of claim 20, wherein the step of depositing the solder layer is performed so that the portion of the solder layer that is deposited on the first and second metal layers is substantially flush with the layer of insulation material.

22. An electronic device having first and second opposed end surfaces, the device comprising:

a conductive polymer layer sandwiched between first and second metal foil electrodes and first and second metal foil bands, each of the electrodes being separated from one of the metal foil bands by an isolation gap, each of the electrodes and each of the metal foil bands having an external surface;

a first plated layer of conductive metal having first and second end portions respectively covering the first and second end surfaces of the device, a top portion covering the external surfaces of the first electrode and the first metal foil band, and a bottom portion covering the external surfaces of the second electrode and the second metal foil band;

a second plated layer of conductive metal on the first end portion and part of the bottom portion of the plated layer so as to form (a) a first terminal in contact with the first electrode and the second metal foil band through the plated layer, and (b) a second terminal in contact with the second electrode and the first metal foil band through the first plated layer; and first and second thermal stress relief areas etched through the first and second electrodes, respectively, each of the stress relief areas extending through the first plated layer.

23. The electronic device of claim 22, wherein the first isolation gap is vertically aligned with the second thermal stress relief area, and wherein the first thermal stress relief area is vertically aligned with the second isolation gap.

24. The electronic device of claim 22, wherein the device has a predetermined width between the first and second ends, and wherein each of the first and second thermal stress relief areas has a width that is between approximately 25% and approximately 33% of the predetermined width.

25. The electronic device of claim 22, wherein the metal foil is made of a material selected from the group consisting of nickel and nickel-coated copper.

26. The electronic device of claim 22, wherein the conductive polymer layer is made of a material that exhibits PTC behavior.

27. The electronic device of claim 22, wherein the second plated layer is a solder layer applied over the first plated layer.

28. The electronic device of claim 22, further comprising:

an insulative layer on each of the top and bottom portions of the first plated layer and located so as to insulate the first and second terminals from each other and so as to cover the first and second thermal stress relief areas.

29. An electronic device having first and second opposed end surfaces, the device comprising:

a conductive polymer layer having first and second opposed surfaces;

a first metal foil electrode having an internal surface in electrical contact with the first surface of the conductive polymer layer, and an external surface;

a first metal foil band having an internal surface in contact with the first surface of the conductive polymer layer, and an external surface, the first metal foil band being separated from the first electrode by a first isolation gap;

a second metal foil electrode having an internal surface in contact with the second surface of the conductive polymer layer, and an external surface;

a second metal foil band having an internal surface in contact with the second surface of the conductive polymer layer, and an external surface, the second metal foil band being separated from the second electrode by a second isolation gap;

a plated conductive metal layer having first and second end portions respectively covering the first and second end surfaces of the device, a top portion covering the external surfaces of the first electrode and the first metal foil band, and a bottom surface covering the external surfaces of the second electrode and the second metal foil band;

a first etched-out thermal stress relief area in the first electrode and extending through the plated layer;

a second etched-out thermal stress relief area in the second electrode and extending through the plated layer;

a first terminal formed over (a) the first end portion of the plated layer, (b) part of the top portion of the plated layer so as to be in contact with the first electrode through the plated layer, and (c) part of the bottom portion of the plated layer so as to be in contact with the second metal foil band through the plated layer; and a second terminal formed over (a) the second end portion of the plated layer, (b) part of the bottom portion of the plated layer so as to be in contact with the second electrode through the plated layer, and (c) part of the top portion of the plated layer so as to be in contact with the first metal foil band through the plated layer.

30. The electronic device of claim 29, wherein the metal foil is made of a material selected from the group consisting of nickel and nickel-coated copper.

31. The electronic device of claim 29, wherein the conductive polymer layer is made of a material that exhibits PTC behavior.

32. The electronic device of claim 29, wherein the first and second terminals are formed by a solder layer applied over the plated layer.

33. The electronic device of claim 29, further comprising:

an insulative layer on each of the top and bottom portions of the plated layer and located so as to insulate the first and second terminals from each other and so as to cover the first and second thermal stress relief areas.

34. The electronic device of claim 29, wherein the first isolation gap is vertically aligned with the second thermal stress relief area, and wherein the first thermal stress relief area is vertically aligned with the second isolation gap.

35. The electronic device of claim 29, wherein the device has a predetermined width between the first and second ends, and wherein each of the first and second thermal stress relief areas has a width that is between approximately 25% and approximately 33% of the predetermined width.

* * * * *

UNITED STATES PATENT AND TRADEMARK OFFICE

CERTIFICATE OF CORRECTION

PATENT NO. : 6,380,839 B2 
DATED : April 30, 2002
INVENTOR(S) : Li et al.

It is certified that error appears in the above-identified patent and that said Letters Patent is hereby corrected as shown below:

Column 9,
Line 6, "terminals 48, 50, wherein" should be -- terminals 48, 50 to provide electrical isolation between the first and second terminals 48, 50, wherein --.

Signed and Sealed this

Third Day of December, 2002

JAMES E. ROGAN
*Director of the United States Patent and Trademark Office*